US008402958B2

(12) United States Patent
Victor et al.

(10) Patent No.: US 8,402,958 B2
(45) Date of Patent: Mar. 26, 2013

(54) TOY DART MAGAZINE APPARATUS

(75) Inventors: Robert Victor, Sunnyside, NY (US); Raymond Aaron Mead, Pawtucket, RI (US); Robert L. Brown, North Kingstown, RI (US); Fred D. Eddins, Mapleville, RI (US); Meredith Brooks, Attleboro, MA (US); Douglas C. Weiler, Bridgewater, MA (US)

(73) Assignee: Hasbro, Inc., Pawtucket, RI (US)

( * ) Notice: Subject to any disclaimer, the term of this patent is extended or adjusted under 35 U.S.C. 154(b) by 750 days.

(21) Appl. No.: 12/545,305

(22) Filed: Aug. 21, 2009

(65) Prior Publication Data

US 2011/0041823 A1 Feb. 24, 2011

(51) Int. Cl.
*F41A 9/61* (2006.01)

(52) U.S. Cl. ..... 124/45; 124/48; 124/51.1; 124/52; 89/33.02; 89/33.17

(58) Field of Classification Search ..... 124/45, 124/48, 51.1, 52; 89/33.02, 33.17
See application file for complete search history.

(56) References Cited

U.S. PATENT DOCUMENTS 1,328,929 A * 1/1920 McDaniel ..... 124/29
2,777,235 A 1/1957 Hopkins
2,962,017 A * 11/1960 Horowitz et al. ..... 124/27
3,009,453 A * 11/1961 Ayala ..... 124/27
4,127,954 A * 12/1978 Hausmann ..... 42/50
4,289,109 A 9/1981 D'Andrade
4,384,508 A * 5/1983 Sullivan et al. ..... 89/33.02
4,776,122 A * 10/1988 Dieringer et al. ..... 42/50
4,834,059 A 5/1989 Moorhouse et al.
4,879,828 A * 11/1989 Dieringer et al. ..... 42/50
4,888,899 A 12/1989 Chesnut et al.
4,986,251 A * 1/1991 Lilley ..... 124/67
5,099,595 A * 3/1992 Chesnut et al. ..... 42/50
5,156,137 A * 10/1992 Clayton ..... 124/27
5,285,766 A * 2/1994 Milliman ..... 124/72
5,522,374 A * 6/1996 Clayton ..... 124/59
5,529,050 A 6/1996 D'Andrade
5,553,598 A 9/1996 Johnson et al.
5,596,978 A * 1/1997 Johnson et al. ..... 124/72
5,634,564 A 6/1997 Spamer et al.
5,709,199 A * 1/1998 Johnson et al. ..... 124/69
5,724,955 A * 3/1998 Johnson et al. ..... 124/72
5,787,869 A * 8/1998 Johnson et al. ..... 124/69
5,791,326 A 8/1998 Brown et al.
5,913,304 A * 6/1999 Johnson ..... 124/59

(Continued)

*Primary Examiner* — Gene Kim
*Assistant Examiner* — Alexander Niconovich
(74) *Attorney, Agent, or Firm* — Perry Hoffman

(57) ABSTRACT

The wheel also includes an opening in the third portion leading to a chamber in a hollow support of the wheel. A spring-biased knob is mounted on a shaft that also mounts the wheel. Both the knob and the wheel have axially align protrusions that may engage each other to allow the wheel to be rotationally adjusted to correct any jam or misalignment of the darts stored on the wheel. A flexible arm and a pusher structure are also included with the magazine apparatus and are connected to a constant force spring, where the flexible arm and a portion of the constant force spring are lodged in the chamber of the hollow support during a dart loading process of the wheel, and the constant force spring uncoils when the wheel is rotated during the loading process. The constant force spring biases the wheel to feed the darts from both the drum and the clip to a firing position at the end of the clip located in the launcher, but the constant force spring is insufficient to discharge the darts when the magazine is not connected to the launcher.

20 Claims, 8 Drawing Sheets

U.S. PATENT DOCUMENTS 6,109,252 A * 8/2000 Stevens ..... 124/51.1
6,327,953 B1 * 12/2001 Andresen ..... 89/33.17
6,408,837 B1 * 6/2002 Johnson et al. ..... 124/51.1
6,439,216 B1 * 8/2002 Johnson et al. ..... 124/70
6,488,019 B2 * 12/2002 Kotsiopoulos ..... 124/51.1
6,752,137 B2 * 6/2004 Brunette et al. ..... 124/74
6,796,300 B2 * 9/2004 Petrosyan et al. ..... 124/48
7,222,617 B2 * 5/2007 Andresen ..... 124/51.1
7,234,456 B2 * 6/2007 Andresen ..... 124/51.1
7,267,118 B2 9/2007 Eddins et al.
7,287,526 B1 * 10/2007 Bligh et al. ..... 124/63
7,357,130 B2 * 4/2008 Broersma ..... 124/51.1
7,458,371 B2 * 12/2008 Ong et al. ..... 124/65
7,694,669 B2 * 4/2010 Campo ..... 124/51.1
8,061,342 B2 * 11/2011 Christopher et al. ..... 124/51.1
8,091,541 B2 * 1/2012 Andresen ..... 124/51.1
2006/0042613 A1 * 3/2006 Hu ..... 124/48
2006/0180134 A1 * 8/2006 Illuzzi ..... 124/74
2009/0145412 A1 * 6/2009 Barish ..... 124/69
2009/0211562 A1 * 8/2009 Karnis ..... 124/48
2009/0314272 A1 * 12/2009 Lin ..... 124/48

* cited by examiner

TOY DART MAGAZINE APPARATUS

FIELD OF THE INVENTION

The present invention relates generally to a toy dart magazine apparatus, and, more particularly, to a toy dart magazine apparatus designed to mate with a toy launcher to simulate a rapid-fire machine gun, where each toy dart is a foam dart or the like made of a soft, spongy, cellular material.

BACKGROUND OF THE INVENTION

Toys are often created to have play value by simulating non-toy or real items at an expense perceived as reasonable for a toy product. Nevertheless, creating such toys is both difficult and expensive, and many marketed toys are not commercially successful. Many toy concepts do not even reach commercialization. The toy industry develops new toys on a yearly basis and refreshes existing toys to continue interest in the toys for different age groups or for a new group of children reaching a certain age segment. As mentioned, many times new or refreshed toys do not become marketing successes or they never reach the marketplace. However, efforts continue to be made because commercially successful toys are profitable.

Hasbro has created a line of toys where rapid-fire launchers discharge or "shoot" soft, spongy, cellular darts at targets selected by child operators or users of the launchers. The soft, spongy, cellular material used for the darts has been and continues to be used for many products and is generally known by consumers under Hasbro's trademark NERF.

Magazine apparatus have been designed in the past as shown by various earlier United States patents. These may be best reviewed by dividing the patents into two categories, cartridge magazines to be used with real guns, and magazines for toys products or paint ball launchers. In the category of cartridge magazines for real guns, U.S. Pat. No. 1,290,852 for an "Automatic Gas Operated Firearm" issued to Sturgeon in 1919, purports to disclose a sprocket wheel and a spiral spring for feeding cartridges from a continuous belt. U.S. Pat. No. 2,777,235 to Hopkins issued in 1957, entitled "Firearm Magazine With Negator Coil Springs" purports to illustrate two coiled ribbon springs 21, 22 for biasing a follower 28 upwardly to push against cartridges 34, 36 causing them to exit through a port 20. U.S. Pat. No. 4,127,954 for a "Extended Capacity Cartridge Magazine Structure" issued to Hausmann in 1978, purports to illustrate the use of a negator spring 25, FIGS. 1-6, attached to a follower 20 that biases cartridges 15 to a dispenser opening 12 in a "banana" shaped magazine. In FIG. 14, there is illustrated two negator springs 99, 107, also called "spirally wound springs," connected, respectively, to two followers 97, 105. The spring 99 biases cartridges 100 in the drum section of the magazine toward the straight section of the magazine, and a spring 107 biases cartridges 200 in the straight section of the magazine. U.S. Pat. No. 4,384,508 to Sullivan and Waterfield issued in 1983 for a "Drum Magazine For A Gun" purports to illustrate a drum magazine with three sprockets 42, 43, 44, FIG. 6, biased by a "sheet metal clock-type torsion spring 46," FIGS. 3A, 4 and 5A, to bias cartridges C in a magazine.

U.S. Pat. No. 4,558,626 issued in 1985 to Bartoiles for a "Primer Cartridge Magazine For A Wedge-Type Breech Block" purports to disclose use of a tension band to indicate a count of cartridges stored in a cartridge magazine. U.S. Pat. No. 4,879,828 issued for a "Constant Force Spring For Cartridge Magazines" in 1989 to Dieringer et al., purports to disclose a constant force spring and a follower for lifting a stack of cartridges to a gun where the spring includes an anti-curl feature. U.S. Pat. No. 4,986,251 issued in 1991 to Lilley for an "Airgun Magazine" purports to disclose a circular pellet carrier with a coil spring that biases the pellet carrier for loading the pellets into a gun.

In the category of magazines for toy guns and paint projectile launchers, U.S. Pat. No. 6,109,252 issued in 2000 to Stevens for a "Projectile Feed System" purports to disclose an apparatus for feeding paint balls to a paint ball gun. Paint balls are received in pockets around the a periphery of a carrier, and rotation of the carrier moves the paint balls into contact with a guide assembly for directing the paint balls to the gun. U.S. Pat. No. 6,408,837 issued in 2002 to Johnson et al., for a "Toy Gun With Magazine" purports to disclose a magazine with an internal indexing wheel having an annular array of divider walls, where the magazine is operated pneumatically to position a projectile and then uses a coiled spring to return the magazine to an original position.

A U.S. Publication No. 2006/0180134 published in 2006 and listing Illuzzi as inventor for a "Combination Solid Projectile And Paintball Gun, And Solid Projectile Adapter For Paintball Gun" purports to disclose a number of different shaped magazines and different shaped projectiles for feeding a gun by compressed gas. U.S. Pat. No. 7,222,619 for a "Device For Storing Projectile Balls And Feeding Them Into The Projectile Chamber Of A Hand Gun" issued in 2007 to Andresen, purports to disclose a paint ball feeding device with a feeder having feeder chambers and being driven by an electric motor with a slip clutch. An earlier patent listing the same inventor, Andresen, U.S. Pat. No. 6,327,953, purports to disclose a structure similar to the first mentioned Andresen patent. A slightly later patent again listing the same inventor, Andresen, U.S. Pat. No. 7,234,456, entitled "Device For Feeding Balls Into The Ball Chamber Of A Handgun," purports to disclose the same structure as shown in his earlier U.S. Pat. No. 7,222,619. U.S. Pat. No. 7,357,130 for a "Spring-Assisted Paintball Loader" issued in 2008 to Broersma purports to disclose a paintball loader having a motor driven spinning spool and a spiral spring to avoid "dry firing" when the spool is not being driven.

These disclosures, while interesting, do not disclose a toy dart magazine that is useful and cost effective for a toy, especially for a toy operating with soft darts.

SUMMARY OF THE INVENTION

In accordance with the present invention, an advantageous apparatus and a process is provided in the form of a toy dart magazine that is especially designed to mate with a toy dart launcher. One described embodiment includes a toy dart magazine apparatus which aligns and stores foam or cellular material darts, e.g. NERF™ brand darts where the dart magazine apparatus is formed to engage a toy launcher such as a NERF N-STRIKE VULCAN EBF-25 BLASTER™, a product marketed by Hasbro™. Advantages of the toy dart magazine are that the magazine is simply constructed, structurally robust and reliably manufactured. The magazine apparatus is able to handle the solid but spongy cellular material that forms many elements of NERF products. The unique dart magazine structure features a combination drum and clip arrangement where movement of the darts in the magazine, during both a loading operation and during ejection when in combination with a launcher, is accomplished smoothly and includes special structures to ease any jamming problem.

The toy dart magazine apparatus includes a housing having a first housing portion, and a second housing portion connected to the first housing portion, an alignment and storage structure having peripheral dart recesses, the alignment and storage structure being rotationally mounted in the housing, a main spring connected to the housing for biasing the alignment and storage structure and for biasing darts located in the housing, and a knob structure connected to the housing and selectively moveable for engaging the alignment and storage structure to enable rotational adjustment of the alignment and storage structure.

The apparatus and processes may also employ a flexible arm pivotally connected to the main spring at one end and to a pusher structure at the other end. A spring-biased knob is mounted on a shaft that also mounts the wheel. Both the knob and the wheel have axially align protrusions that may engage each other to allow the wheel to be rotationally adjusted to correct any jam or misalignment of the darts stored on the wheel. In a described embodiment the flexible arm and a pusher structure are also included with the magazine apparatus and are connected to a constant force spring, where the flexible arm and a portion of the constant force spring are lodged in the chamber of the hollow support during a dart loading process of the wheel, and the constant force spring uncoils when the wheel is rotated during the loading process.

The constant force spring biases the wheel to feed the darts from both the drum and the clip to a firing position at the end of the clip located in the launcher, but the constant force spring is insufficient to discharge the darts when the magazine is not connected to the launcher. A method for configuring a toy dart magazine apparatus includes the novel process of forming a housing, forming an alignment and storage structure having peripheral recesses for mounting darts, rotatably mounting the alignment and storage structure in the housing, mounting a spring to the housing and to the alignment and storage structure to bias the alignment and storage structure, forming a knob, and mounting the knob to selectively engage the alignment and storage structure to enable the alignment and storage structure to be rotated manually.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiment set forth in the best mode contemplated for carrying out the invention. Various modifications, equivalents, variations, and alternatives, however, will become readily apparent to those skilled in the art. Any and all such modifications, variations, equivalents, and alternatives are intended to fall within the spirit and scope of the present invention.

Figure 1:
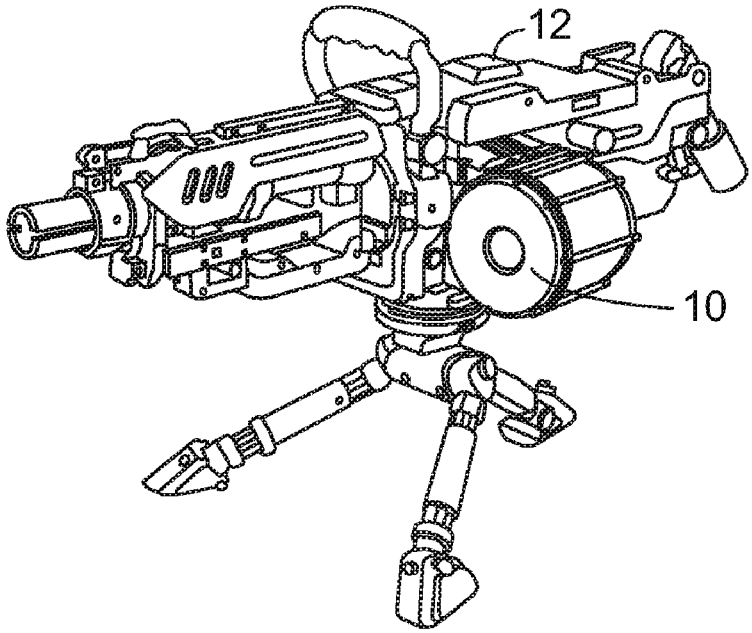
FIG. 1 is an isometric view of a preferred embodiment of the inventive toy dart magazine apparatus mounted to a toy launcher.
Figure 2:
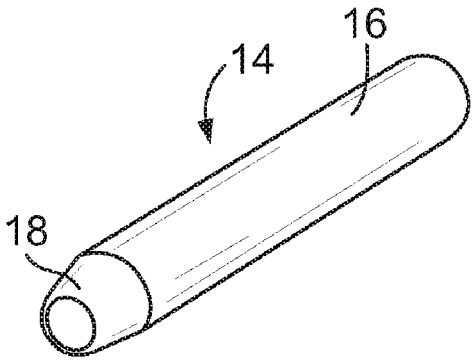
FIG. 2 is an enlarged front isometric view of a dart formed of Nerf material.
Figure 3:
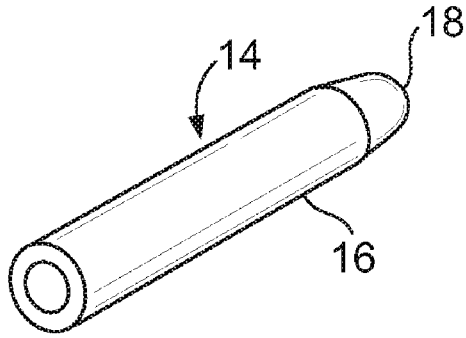
FIG. 3 is a rear isometric view of the dart shown in FIG. 2.

Referring now to the Figures, FIGS. 1, 2 and 3, there is illustrate an embodiment of the invention in the form of a toy dart magazine apparatus 10 shown mounted to a toy dart launcher 12, similar to a launcher marketed by Hasbro™ under the brand NERF N-STRIKE VULCAN EBF-25 BLASTER™. The dart launcher 12 simulates a stylized machine gun and the dart magazine 10 simulates a cartridge magazine for the dart launcher. The magazine is constructed to store and align darts and then feed the darts, such as the dart 14, to a position for the dart launcher to discharge. Each dart 14 is formed of a solid, spongy cellular material produced generally by the reaction of polyester with a diisocyanate while carbon dioxide is liberated by the reaction of a carboxyl with the isocyanate. The carbon dioxide gas creates open pockets within the polyurethane that makes the material soft and light. The solid, spongy cellular material is used in a number of products marketed by Hasbro under the NERF brand including foam or cellular material darts. In the alternative, other soft material may be used with the magazine and launcher described here. The dart includes a simulated shell portion 16 and a simulated bullet portion 18.

Figure 4:
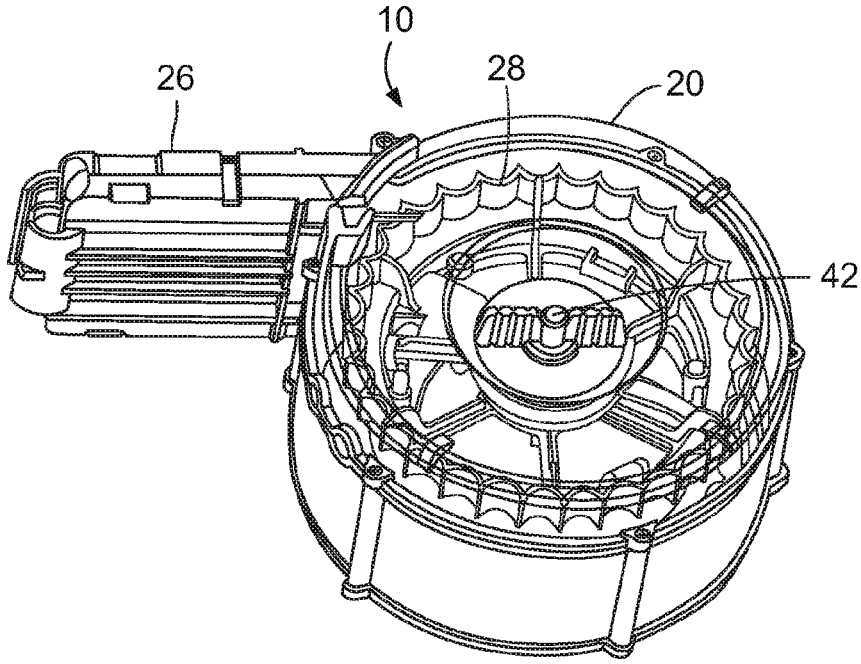
FIG. 4 is an isometric view of the magazine apparatus in an empty condition.
Figure 5:
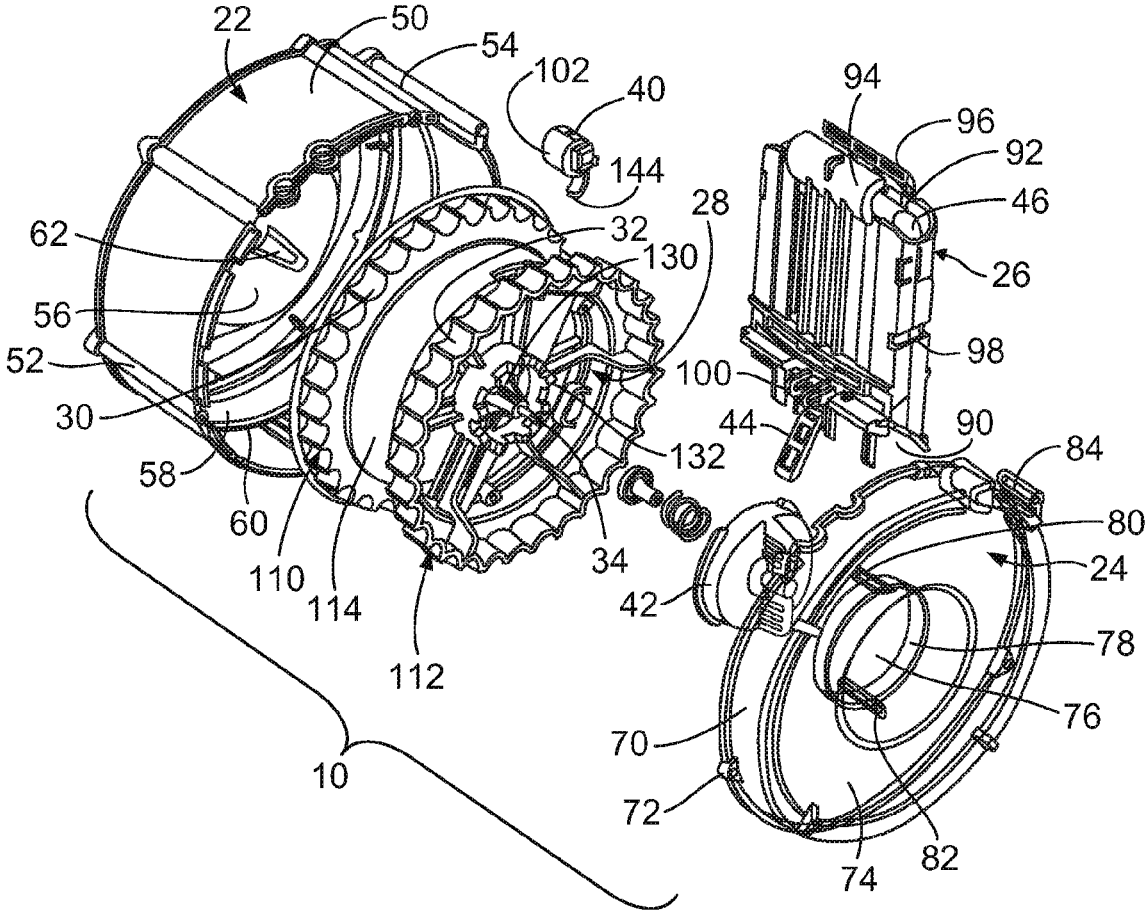
FIG. 5 is an exploded isometric view of the magazine apparatus shown in FIG. 4.

The major elements of the dart magazine apparatus 10, FIGS. 4 and 5, include a first housing portion 20, which is formed of two pieces, a base element 22 and a cover element 24, together often called a drum, and a second housing portion 26, often called a clip. Within the first or drum portion 20 is an alignment and storage structure 28, often called a sprocket wheel, having aligned pairs of peripheral dart recesses, such as the dart recesses 30, 32, and the wheel structure 28 is rotatably mounted to the drum portion 20 on a shaft 34. A main spring 40, mounted to the clip portion, operatively connected to the alignment and storage or wheel structure 28 is used for biasing the wheel structure to feed the darts 14, FIGS. 1 and 2, to the dart launcher 12. A knob structure 42 is mounted to the shaft 34, and the knob structure 42 is axially moveable for selectively engaging the wheel structure 28 to enable rotational adjustment of the wheel structure whereby misalignment and/or compression of a soft dart may be alleviated and jamming of the magazine apparatus may be remedied, a major feature of the magazine.

Figure 6:
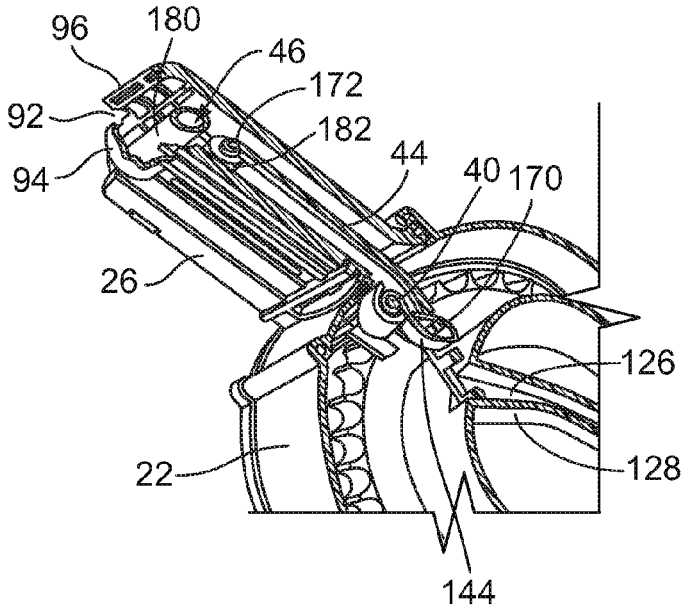
FIG. 6 is a sectional isometric view of a clip portion of the magazine apparatus without any loaded darts.

To allow easy loading of the darts through the clip portion 26 of the magazine apparatus and into the drum portion 20, and to maintain a biasing force on the loaded darts to move them smoothly around the drum portion 20 back through the clip portion 26 and into alignment with the launcher 12, the main spring 40 is connected to a flexible arm 44, FIGS. 5 and 6, and the flexible arm 44 is connected to a pusher structure 46.

The base element 22, FIG. 5, of the drum portion 20 is formed in a generally cylindrical shape and includes a circular outer wall 50 with spaced fastener sleeves, such as the fastener sleeve 52, and an axially aligned opening 54 to receive and engage the clip portion 26 of the magazine apparatus. The clip portion 26 is attached to the drum portion 20 by sliding the clip portion over the opening 54 and engaging complementary flanges on the two structures. In the alternative, other structures may be used to connect the clip portion to the drum portion, such as screws or other fasteners. An end wall 56 encloses one end of the circular wall 50 and the cover element 24 encloses the opposite end of the circular wall 50. Along an inside surface 58 of the circular wall 50 is a ledge 60 indicating a thickening of the circular wall for effectively reducing the inner diameter of the drum portion 20. The end wall 56 includes a shaft sleeve 62 for engagement with and mounting of the shaft 34.

The cover element 24 is also formed in a generally cylindrical shape and includes a circular wall 70 with spaced short fastener sleeves, such as the short fastener sleeve 72 that cooperates with the fastener sleeve 52. Any suitable fastener may be used to attach the cover element 24 to the base element 22, such as small screws (not shown). One end of the cover circular wall 70 is open and an opposite end includes a wall 74 with a central circular opening 76. Surrounding the opening 76 is a circular flange 78. A pair of tubular elements 80, 82 are connected to the circular flange 78 and extend axially. The cover element includes an axially aligned opening 84 in the circular wall 70 that aligns with the opening 54 of the base element 22 and is also used for engaging the clip portion 26.

The clip portion 26 is formed as an elongated rectangular box, open at both ends. A first end 90 is configured to engage the drum portion 20 through the axial openings 54, 84 in the circular walls 50, 70 of the drum portion, and a second end 92 provides an opening to the magazine apparatus interior for loading and storing darts, and is configured with two curved arms 94, 96 to confine the darts loaded in the magazine apparatus and to align the darts relative to the launcher. A lateral slot 98 is formed perpendicular to a longitudinal axis of the clip portion. The lateral slot receives a detent (not shown) of the launcher for mounting the magazine apparatus 10 to the launcher 12, as shown in FIG. 1. Adjacent to the first end 90 of the clip portion 26 is an attachment structure 100 for receiving a holder 102 for the main spring 40. Any suitable material may be used for the drum and clip portions of the magazine apparatus, such as a moldable synthetic resin.

Figure 7:
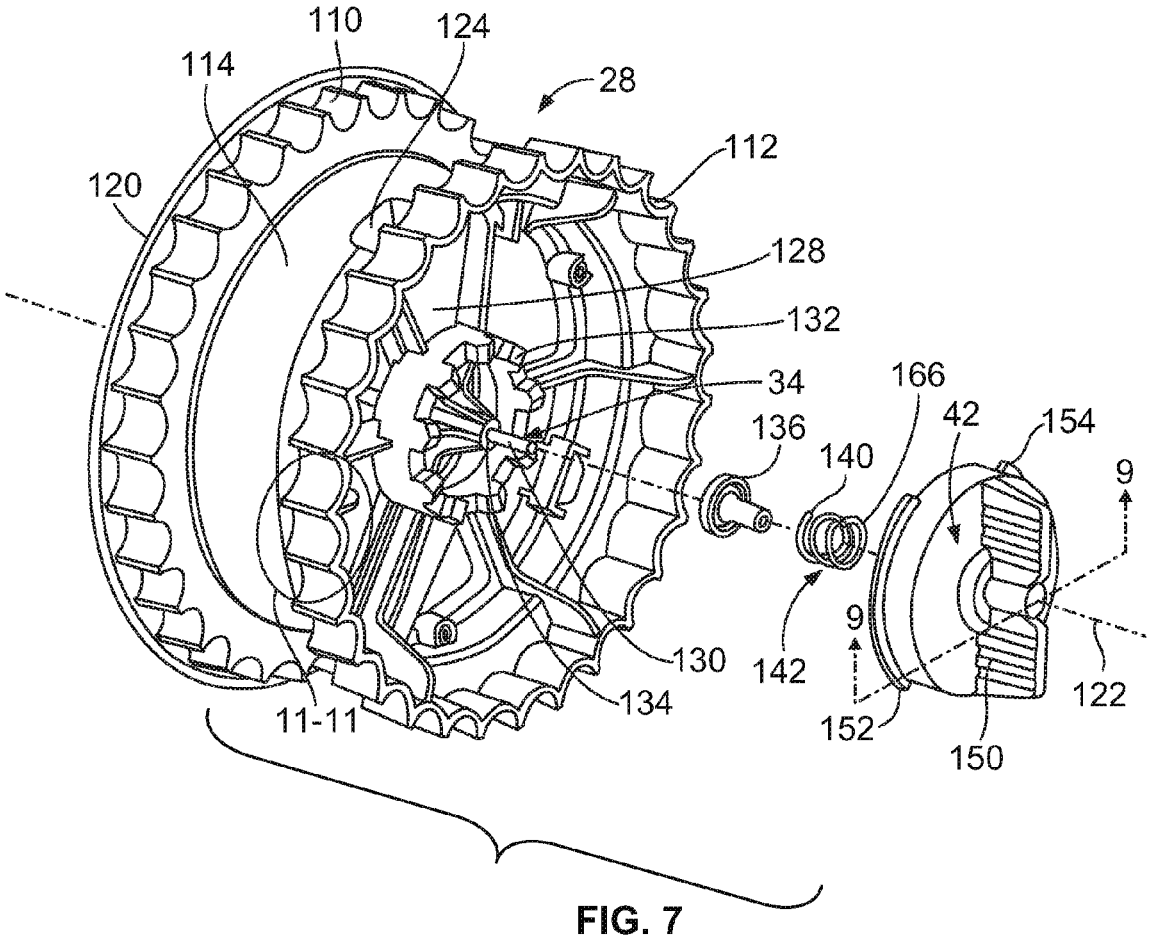
FIG. 7 is an enlarged exploded isometric view of a wheel structure, shaft, knob and spring of the magazine.
Figure 8:
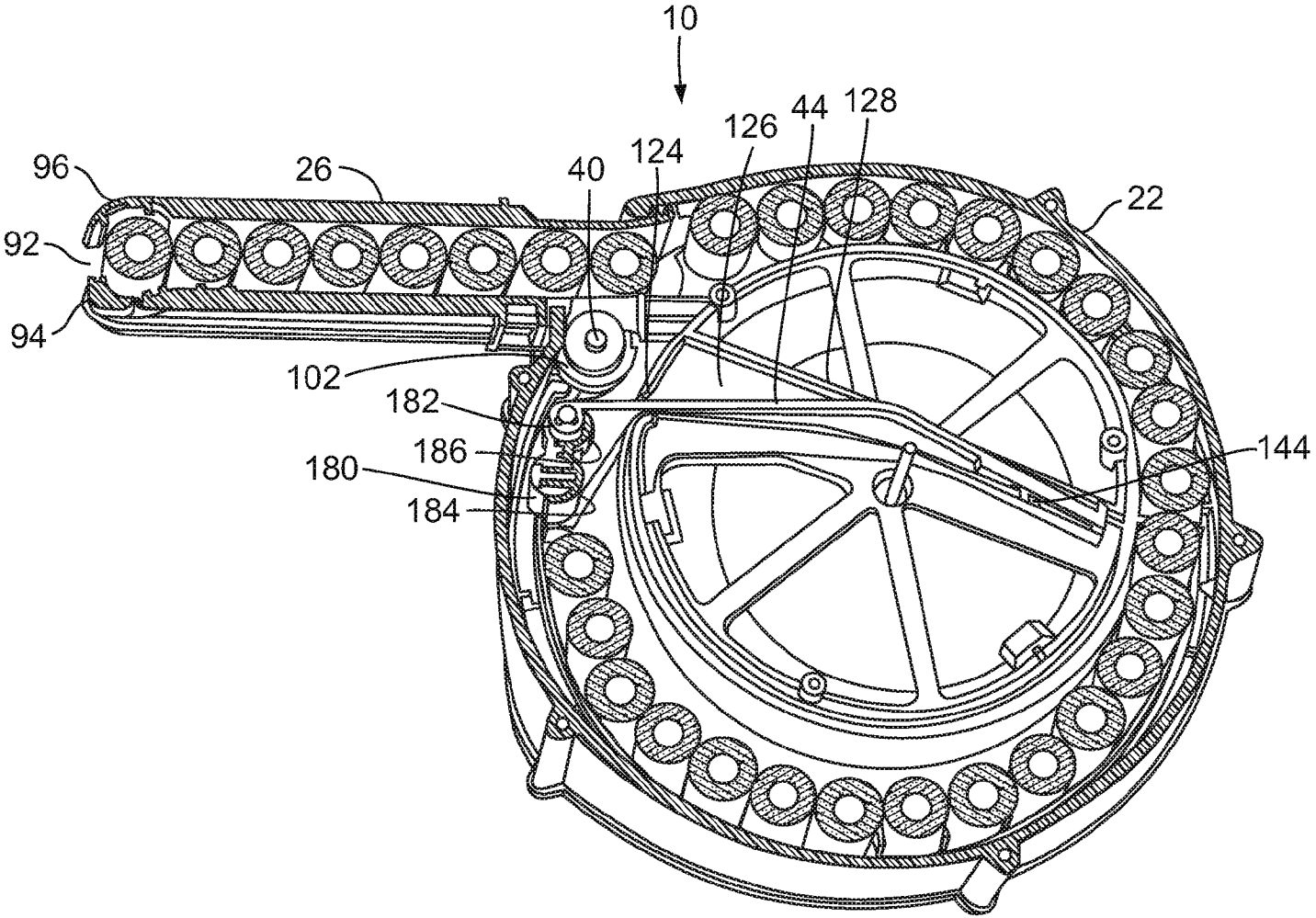
FIG. 8 is a sectional isometric view of the magazine apparatus fully loaded with darts.

The wheel structure 28, FIGS. 5 and 7, has a generally wheel-like configuration with two spaced apart peripheral rim portions 110, 112 forming dart carrying recesses, such as the pair of recesses 30, 32, separated by a smooth middle portion 114. The middle portion 114 is of a lesser diameter than the peripheral rim portions 110, 112. An end wall portion 120 abuts the peripheral rim portion 110 whereby a dart stored in a pair of aligned recesses is maintained in proper alignment relative to the wheel structure and to other darts. The darts are aligned and stored on the wheel structure 28 in an axial direction, as shown in FIG. 8. The word "axial" refers to a direction that is parallel to a longitudinal centerline 122, drawn in FIG. 7.

Formed in the middle portion 114 of the wheel structure 28 is an opening 124 that allows access to a chamber 126, FIG. 6, in a radially askew hollow support 128. The chamber enables the flexible arm 44 and an extended end portion of the main spring to be housed during loading of the magazine apparatus with darts, as will be explained in more detail below. A central axial opening 130 is provided for the shaft 34 to allow the wheel structure 28 to be rotatably mounted to the drum portion 20 of the magazine apparatus 10. Radially spaced about the axial opening 130 are a series of protrusions, such as the protrusion 132, for engagement with the knob 42 as will also be explained in greater detail below. The word "radial" refers to a direction that is perpendicular to the centerline 122. Any suitable material may be used for the wheel structure 28, such as a moldable synthetic resin.

The shaft 34 may be configured as a metal rod 134, FIG. 7, and a plastic cap 136. The metal rod insures smooth rotation of the wheel structure 28, and the plastic cap 136 acts as a spring seat for one end 140 of a second or knob spring 142 placed between the plastic cap 136 and the knob 42 for biasing the knob in an axial direction. The main spring 40, FIG. 5, is known as a constant force or negator spring and is formed of a prestressed strip of flat spring stock coiled tightly around a bushing or around successive layers of itself in a manner very similar to a common household tape measure. When an exposed or extended end portion 144 of the main spring 40 is extended or uncoiled, the pre-stressed strip flattens itself to store energy, whereby a force is created having a tendency to recoil the spring. However, this force does not generally increase as the end portion 144 is extended further away from the coiled portion of the main spring. The constant force main spring 40 is very useful for maintaining a rotational biasing force on the wheel structure 28 when the wheel structure is loaded with darts. The main spring 40 is used to bias the wheel structure 28 from a dart-loaded condition as shown in FIG. 8 to a dart unloaded condition as shown in FIG. 6. Another feature of the magazine apparatus is that multiple darts may be correctly positioned in the launcher without the necessity of a motor and batteries.

Figure 9:
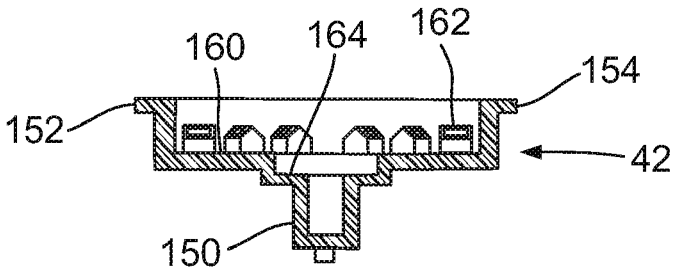
FIG. 9 is a sectional view of the knob taken along line 9-9 of FIG. 7.
Figure 10:
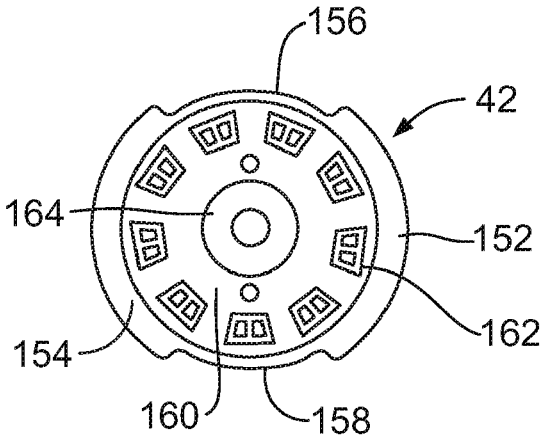
FIG. 10 is a rear elevation view of the knob.

The knob 42, FIGS. 7, 9 and 10, includes an outer handle portion 150 and two flange portions 152, 154, each flange extending less than half way around the knob, about one hundred and ten degrees, so as to leave two openings 156, 158, each extending about seventy degrees. Each of the two openings 156, 158 between the flange portions 152, 154 receives one of the tubular elements 80, 82, FIG. 5, of the cover element 24 to prevent rotation of the knob beyond a predetermined distance because the flange portions and the tubular elements will abut each other after a limited rotation of the knob. An inner side 160 of the knob 42 includes a circular pattern of protrusions, such as the protrusion 162, that are intended to engage the wheel structure protrusions, such as the protrusion 132, FIG. 7. The inner side 160 of the knob also includes a spring seat 164 for a second end 166 of the knob spring 142.

Usually, the protrusions 132, 162 of the knob and of the wheel structure are kept out of engagement with one another by the knob spring 142. However, because the Nerf darts are of a very soft material, they are easily compressed and may become distorted, unlike metal cartridges that are self supporting, such that when a dart falls out of proper alignment in the magazine apparatus 10 and is compressed and/or distorted, an operator or user of the magazine apparatus is able to push the knob 42 inwardly against the force of the knob spring 142 and engage the two sets of protrusions. By giggling the knob back and forth, the user is able to momentarily override the biasing force of the main spring, and the nonaligned dart is likely to properly seat or reseat itself in a pair of recesses where the dart is supposed to be located. This rotational adjustment feature is very advantageous because of the nature of the soft darts being handled by the wheel structure. The knob may be made of any suitable material, such as a synthetic resin.

Figure 13:
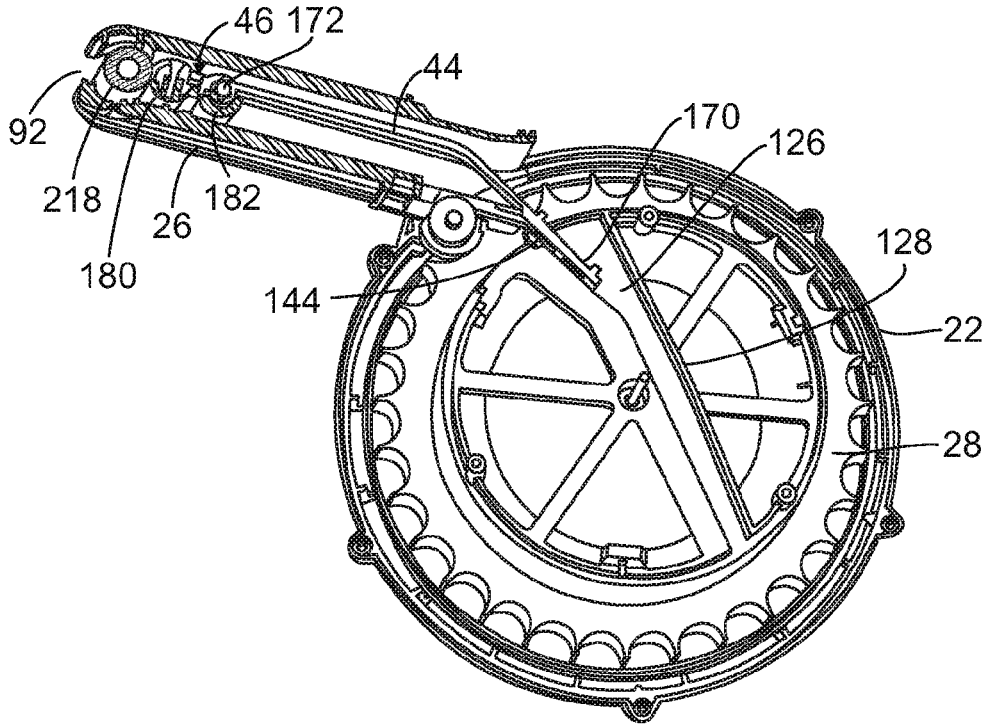
FIG. 13 is a sectional isometric view of the magazine apparatus showing the clip portion loaded with one dart.

The flexible arm 44 is pivotally connected at one end portion 170, FIG. 6, to the main spring 40, and at the other end portion 172, the flexible arm is pivotally connected to the pusher structure 46. The flexible arm is configured to flex as the wheel structure is rotated, during which darts are added to or removed from the wheel structure. The flexible arm 44 is configured to also move into the clip portion 26 of the magazine apparatus, as shown in FIG. 6, while under the continuing influence of the biasing force of the main spring 40. The flexible arm 44 also has a slight biasing force of its own to help push the darts to the curved arms 94, 96 when the flexible arm enters the clip portion 26, as shown in FIGS. 6 and 13. An advantage of the flexible arm is that it allows the magazine apparatus to operate using only one main spring, whereas other magazine devices having both drum and clip portions use two or more springs to generate the proper biasing force on the stored darts throughout a magazine emptying process.

Figure 15:
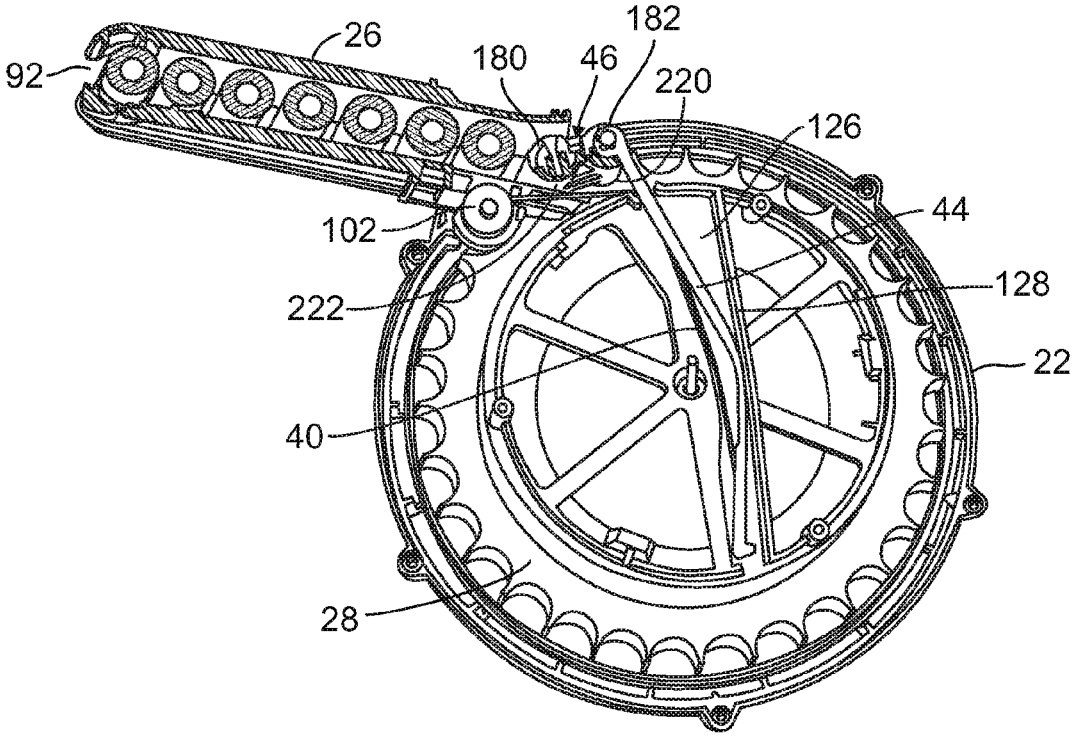
FIG. 15 is a sectional isometric view of the magazine apparatus showing more loaded darts, and the pusher structure in contact with one pair of recesses of the wheel structure.

The pusher structure 46 is configured as two generally cylindrical elements, a trailing element 180, and a leading element 182, FIG. 6, connected to one another or molded together, and they somewhat resemble two darts that fit into two adjoining pairs of recesses, such as the two pairs of recesses 184, 186, FIG. 8, of the wheel structure 28 when the wheel structure is being loaded with darts, as shown in FIG. 15. The pusher structure 46 is also configured to move within both the drum and the clip portions. When the magazine apparatus is filled with darts, the pusher structure occupies the last two pairs of recesses in the drum portion and also causes the main spring 40 to be extended to its fullest extent in operation of the magazine apparatus as seen in FIG. 8.

As the launcher is operated to discharge or "shoot" the darts, other darts in the magazine apparatus are moved toward the launch position continually so that they may be serially discharged, and the pusher structure 46 moves smoothly as it transitions from the drum portion 20 of the magazine apparatus to the clip portion 26 of the magazine apparatus. A generally constant biasing force is maintained on the darts in the magazine apparatus 10 during the whole time darts are stored in the magazine apparatus, and until the last dart is removed from the magazine apparatus by the launcher 12. The arrangement just described provides a major advantage of the magazine apparatus because of the simplicity of its structure, its inexpensive design and its robust construction. Any suitable material may be used for the flexible arm and the pusher structure, such as a moldable synthetic resin.

Figure 11:
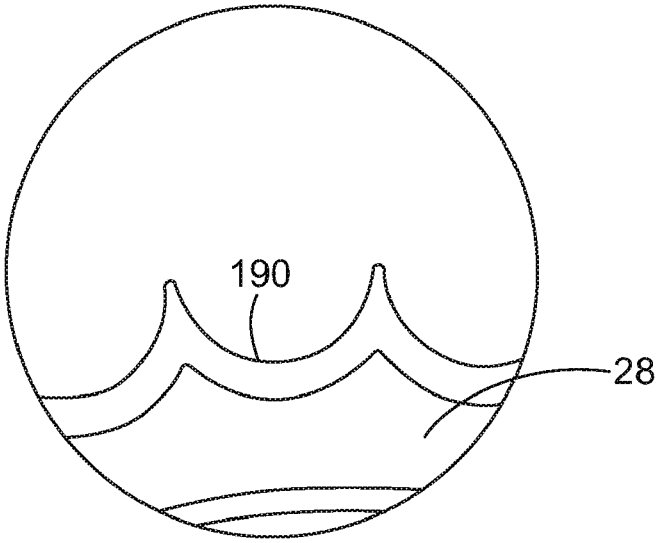
FIG. 11 is an enlarged view of the wheel structure taken within the circle 11-11 in FIG. 7.

Another major advantage of the wheel structure, as shown in FIG. 11, is that each recess is configured to maintain it respective stored dart in axial alignment and insulated from any distorting force. Each recess, such as the recess 190, has a depth from bottom to top of about 0.25 inches/6.31 millimeters and a recess width of about 0.55 inches/13.86 millimeters. The diameter of each dart is about 0.50 inches/12.6 millimeters. The combination of the recess dimensions, the diameter of the wheel structure, about 5.42 inches/13.7 millimeters, and the inner diameter of the ledge of the drum portion, about 5.94/15 millimeters, helps insure that each dart remains seated in a pair of recesses until that dart is directed into the clip portion of the magazine apparatus. The ratio of recess depth to dart diameter is about 1 to 2.

Figure 12:
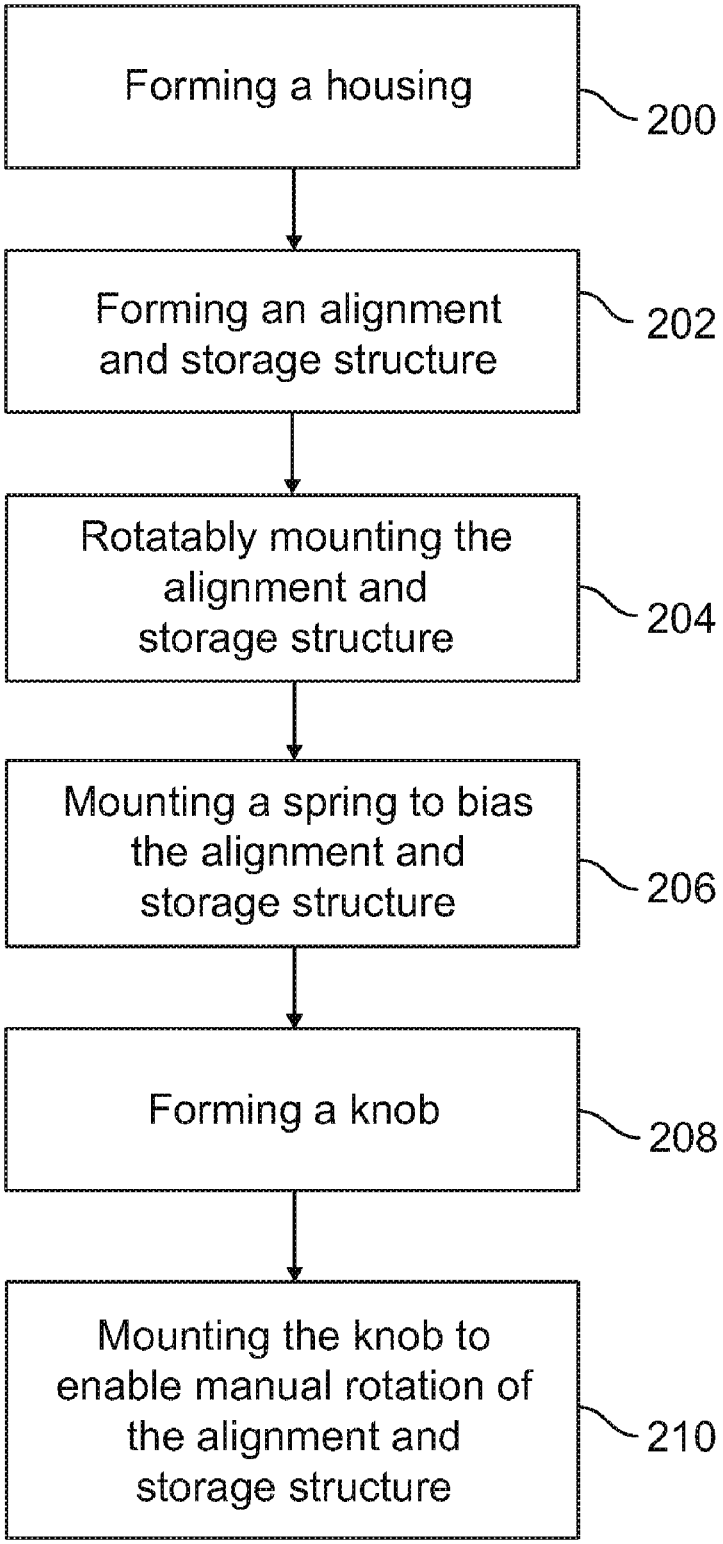
FIG. 12 is a flow diagram of a method for configuring the toy dart magazine apparatus.

A method for configuring the toy dart magazine apparatus includes forming 200, FIG. 12, the housing drum and clip portions 20, 26 and forming 202 the wheel structure 28. The wheel structure 28 is rotatably mounted 204 in the housing. The main spring 40 is mounted to the housing and operatively connected 206 to the wheel structure. The main spring is pivotally mounting to the one end 170 of the flexible arm 44, and the other end 172 of the flexible arm is pivotally connected to the dart engagement or pusher structure 46 to enable the pusher structure, flexible arm and main spring to bias the wheel structure when it is loaded with darts. The knob 42 is formed 208 and mounted 210 to the shaft 34 to selectively engage the wheel structure by way of the two sets of protrusions 132, 162, one set of protrusions 162 on the knob and the other set of protrusions 132 on the wheel structure.

The knob is spring mounted so that a user may selectively push the knob axially inward to engage the two sets of protrusions allowing the user to twist the knob and thereby rotate the wheel structure; otherwise, the knob spring 142 biases the knob protrusions away from, and out of engagement with, the wheel structure protrusion. When the two sets of protrusions are engaged, the user is able to manually rotate the wheel structure slightly back and forth to facilitate proper alignment of the darts on the wheel structure peripheral recesses 30, 32 should one of the darts move out of proper alignment with the wheel structure. The pusher structure 46 is configured to engage the peripheral dart recesses of the wheel structure and thereby be in a position to cause the wheel structure to be biased by the main spring.

Figure 14:
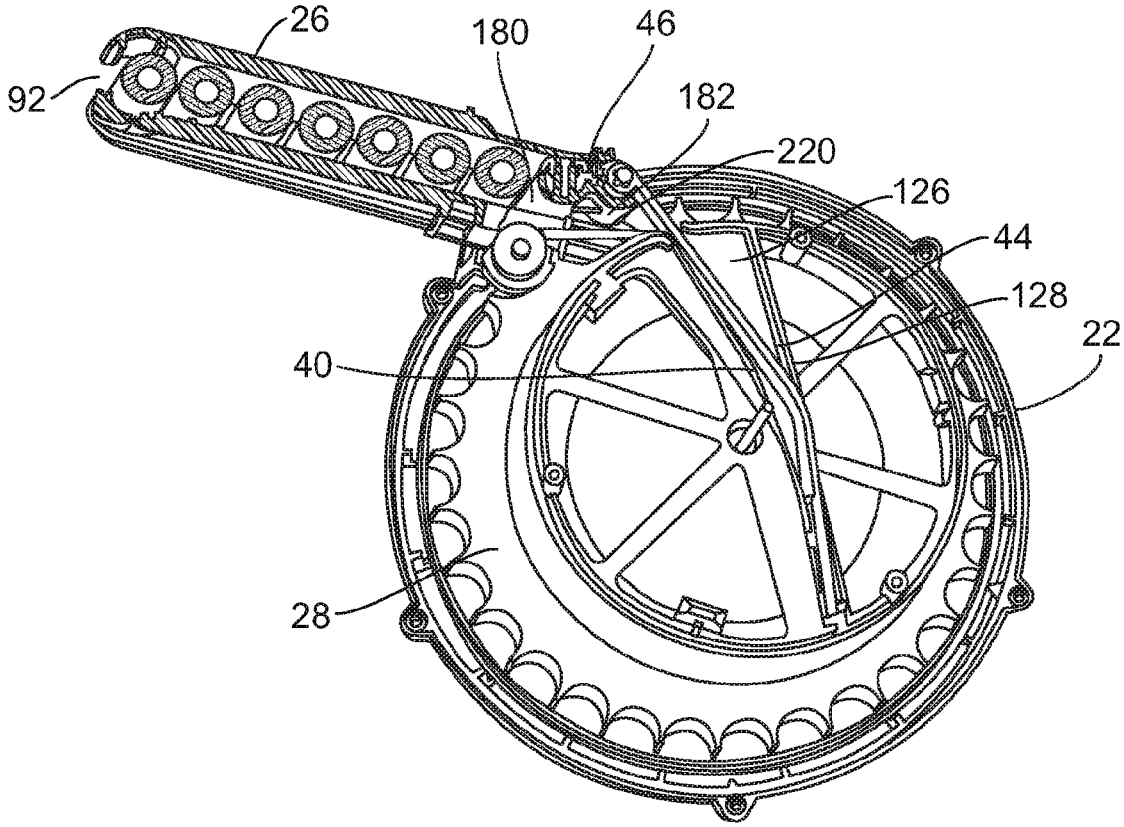
FIG. 14 is a sectional isometric view of the magazine apparatus showing the clip portion loaded with seven darts, and a pusher structure almost in contact with a pair of recesses of the wheel structure.
Figure 16:
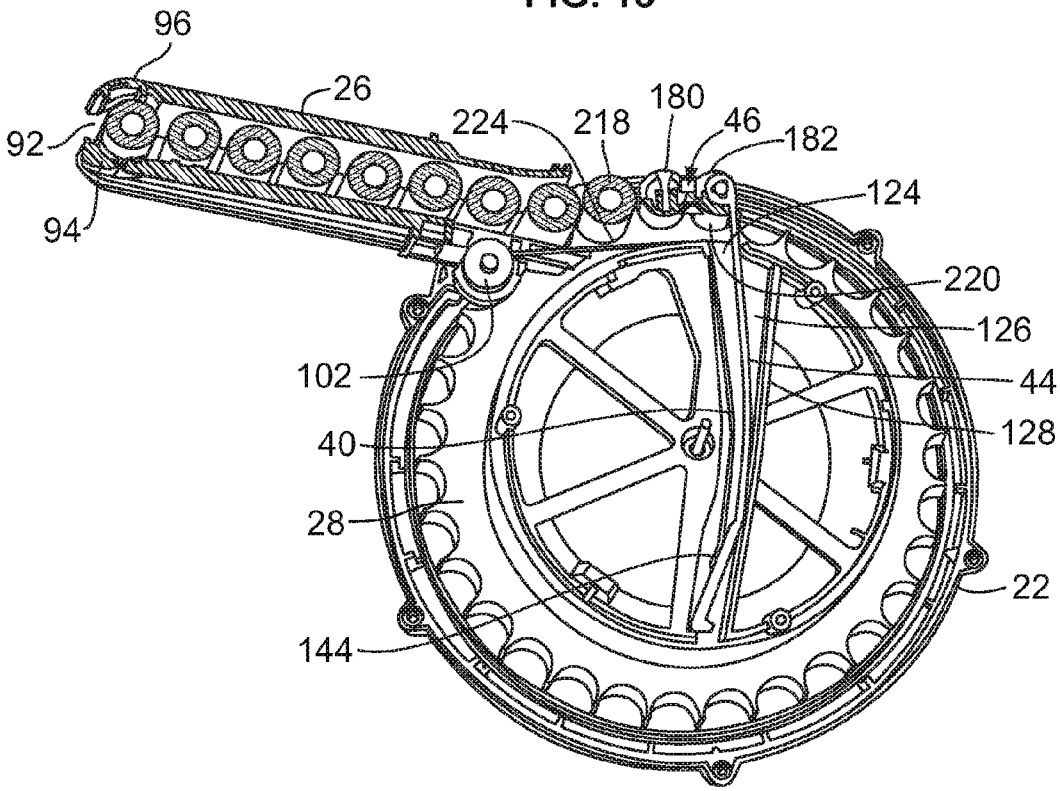
FIG. 16 is a sectional isometric view of the magazine apparatus showing still more loaded darts, the pusher structure in contact with two pairs of recesses of the wheel structure, and one dart in contact with the next pair of recesses of the wheel structure.

Referring now to FIGS. 13-16, as well as to FIGS. 6 and 8, a user of the magazine apparatus 10, when in operation, loads a plurality of the darts 14 into the magazine one at time through the second end portion 92 of the clip portion 26 of the magazine apparatus. An empty magazine is shown in FIG. 6. As each dart is inserted into the clip portion 26, the pusher structure 46 and the flexible arm 44 move left to right when viewed as in FIGS. 13 and 14, for example. One inserted dart 218 is shown in FIG. 13. The pusher structure 46 and the flexible arm 44 are mostly in the clip portion 26. However, the end portion 170 of the flexible arm and the extended end 144 of the main spring are already located in the chamber 126 of the hollow support 128. In FIG. 14, the clip portion is shown almost filled with darts and the leading element 182 of the pusher structure has engaged a pair of wheel structure recesses 220, and the flexible arm 44 has moved into the chamber 126 of the hollow support 128. The addition of another dart to the clip portion causes the trailing element 180 of the pusher structure to also engage the wheel structure in another pair of recesses 222 as shown in FIG. 15. Adding yet another dart to the clip portion second end 92 results in the first loaded dart 218 engaging another pair of recesses 224 of the wheel structure 28 as shown in FIG. 16. Each successively loaded dart causes a dart at the right end of the clip portion to engage the wheel structure 28 and rotate with the wheel structure another approximately ten degrees.

Continued loading causes the pusher structure 46, engaged with the two pairs of recesses 220, 222 to rotate with the wheel structure in a clockwise direction as viewed in FIG. 16. As the wheel structure rotates, the main spring 40 uncoils and is disposed in the middle portion 114 of the wheel structure. As the main spring is extended, a biasing force, generally constant, is created having a tendency to rotate the wheel structure in a counterclockwise direction thereby causing the darts to move to the second end 92 of the clip portion of the magazine apparatus. However, the darts do not unload or exit the magazine apparatus by themselves because the curved arms 94, 96 prevent such movement when the magazine apparatus is not engaged with a launcher. Another feature of the present invention is that a balance is achieved between the main spring's biasing force on the one hand and dart friction at the end of the clip portion on the other hand. When the magazine is full, there are about thirty-five darts when the magazine apparatus has a diameter of a little less than six and a half inches as shown in FIG. 8. The uncoiled main spring extends from the end 144 up through the chamber 126 of the hollow support 128, through the opening 124, around the middle portion 114 of the wheel structure, and back to the main spring holder 102.

The curved arms 94, 96 of the clip portion of the magazine apparatus correctly position the darts for the launcher. Thereafter, the magazine apparatus may be snapped-fitted into the launcher so that the darts may be discharged. As each dart from the magazine apparatus is discharged or fired by pneumatic means from the launcher, the biasing force of the main spring 40 causes the next dart in procession to be positioned between the curved arms ready for launch. The biasing force, however, is not sufficient to push the darts beyond the curved arms. The biasing force of the main spring acts on the darts by way of the main spring's connection to the flexible arm, the flexible arm's connection to the pusher structure, and the pusher structure's engagement of two pairs of peripheral recesses of the wheel structure. The main spring rotates the wheel structure until the wheel structure is empty of darts, and thereafter, the pusher structure acts directly against the darts in the clip portion 26 of the magazine apparatus, pushing the darts leftward toward the curved arms. The dart unloading process is also exemplified by FIGS. 8 and 13-16, but in reverse. It is to be noted that use of the main spring, the flexible arm and the pusher structure allows for a smooth transition of the darts as well as the pusher structure between the clip and the drum portions of the magazine apparatus as darts are added to or subtracted from the magazine structure. The elements of the magazine apparatus are relatively simple, robust and inexpensive where only one main spring is required for the magazine system to operate. When the pusher structure reaches the end of the clip portion, as shown in FIGS. 4 and 6, the magazine apparatus is empty and manual loading may begin again. In the alternative, the magazine apparatus may be refilled with darts after discharging only a portion of the loaded darts.

From the foregoing, it can be seen that there has been provided features for an improved toy dart magazine where the housing is divided into a drum portion and a clip portion, with a wheel structure rotatably mounted to the drum portion. The wheel has four portions, two spaced apart portions having peripheral recesses for receiving the darts and storing them until they are "fired" by a launcher to which the dart magazine apparatus is mounted. A third portion having a smooth circumference and a smaller diameter than the two recess bearing portions wherein the third portion separates the two spaced apart portions. The fourth portion of the wheel has a larger diameter than the two recess bearing portions and is positioned adjoining one of the two recess bearing portions for aligning the darts relative to the wheel. The wheel also includes an opening in the third portion leading to a chamber in a hollow support of the wheel. The apparatus and processes may also employ the described flexible arm pivotally connected to the main spring at one end and to a pusher structure at the other end. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on prior art.

What is claimed is:

1. A toy dart magazine apparatus comprising:

a housing having a generally cylindrical portion and a generally tangentially mounted elongated rectangular box portion, the rectangular box portion having an open end for communicating with a dart launcher;

an alignment and storage wheel having peripheral dart recesses, the alignment and storage wheel being rotationally mounted in the housing and the wheel having a radially disposed chamber;

a constant force main spring connected to the housing;

a flexible arm having one end connected to one end of the constant force main spring, the flexible arm being movable between the elongated rectangular box portion of the housing and the chamber of the alignment and storage wheel;

a pusher structure connected to another end of the flexible arm, the pusher structure being movable between the elongated rectangular box and a peripheral dart recess of the alignment and storage wheel, the pusher structure and alignment and storage wheel being pushed around the housing as darts are loaded into the elongated rectangular box portion of the housing resulting in the constant force main spring being extended from the connection of the main spring to the housing and the constant force main spring biasing the alignment and storage wheel and the darts into the elongated rectangular box portion of the housing; and a knob structure connected to the housing and selectively moveable for engaging the alignment and storage wheel to enable rotational adjustment of the alignment and storage wheel.

2. The apparatus of claim 1, wherein:

the alignment and storage wheel includes a chamber extending generally radially for receiving a portion of the main spring.

3. The apparatus of claim 2, wherein:

the knob is mounted to a shaft, and the shaft also mounts the alignment and storage structure;

the knob includes a plurality of axially directed protrusions; and the alignment and storage wheel includes a plurality of axially directed protrusions, wherein when the knob is moved axially, the plurality of protrusions included with the knob engages with the plurality of protrusions included with the alignment and storage structure.

4. The apparatus of claim 3, including:

a second spring mounted to the shaft for biasing the knob in an axial direction.

5. The apparatus of claim 2, wherein:

the alignment and storage wheel includes three portions, two portions having the peripheral dart recesses separated by a middle portion having a diameter less than the diameters of the two portions having the peripheral dart recesses.

6. The apparatus of claim 5, wherein:

the alignment and storage wheel includes a fourth portion positioned adjoining one of the two portions having the peripheral dart recesses, the fourth portion having a diameter larger than the diameters of the two portions having the peripheral dart recesses.

7. The apparatus of claim 1, wherein:

the first housing portion includes a circular wall with an opening for receiving the second housing portion.

8. The apparatus of claim 1, including:

a flexible arm pivotally connected at one end to the main spring; and an engagement structure pivotally connected to another end of the flexible arm.

9. The apparatus of claim 1 wherein:

each peripheral dart recess has a recess depth to dart diameter ratio of about 1 to 2.

10. The apparatus of claim 1 wherein:

the alignment and storage wheel includes a chamber extending generally radially for receiving a portion of the main spring;

the knob is mounted to a shaft, and the shaft also mounts the alignment and storage wheel;

the knob includes a plurality of axially aligned protrusions;

the alignment and storage wheel includes a plurality of axially aligned protrusions, wherein when the knob is moved axially the plurality of protrusions included with the knob engages with the plurality of protrusions included with the alignment and storage wheel;

the knob is biased in an axial direction by a second spring;

the alignment and storage wheel includes four portions, two portions having the peripheral dart recesses separated by a middle portion having a diameter less than the diameters of the two portions having the peripheral dart recesses, and a fourth portion positioned adjoining one of the two portions having the peripheral dart recesses, the fourth portion having a diameter larger than the diameters of the two portions having the peripheral dart recesses; and including a flexible arm pivotally connected at one end to the main spring; and an engagement structure pivotally connected to another end of the flexible arm.

11. The apparatus of claim 10 wherein each peripheral dart recess has a depth to dart diameter ratio of about 1 to 2.

12. A toy dart magazine apparatus comprising:

a housing including;

a first housing portion, and a second housing portion connected to the first housing portion;

an alignment and storage structure having peripheral dart recesses, the alignment and storage structure being rotationally mounted to the housing;

a main spring mounted to the housing for biasing the alignment and storage structure;

an engagement structure for engaging the alignment and storage structure and for engaging a dart; and a flexible arm having first and second end portions, the first end portion being pivotally connected to the main spring and the second end portion being pivotally connected to the engagement structure.

13. The apparatus of claim 12 including:

a knob structure connected to the housing and selectively moveable for engaging the alignment and storage structure to enable rotational adjustment of the alignment and storage structure.

14. The apparatus of claim 13, including:

a shaft mounted to the housing; and a spring mounted to the shaft for biasing the knob in an axial direction; and wherein the alignment and storage structure is rotatably mounted to the shaft.

15. The apparatus of claim 14, wherein:

the knob is mounted to the shaft and includes a plurality of protrusions; and the alignment and storage structure includes a plurality of protrusions, wherein when moved axially the knob engages the plurality of protrusions included with the knob with the plurality of protrusions included with the alignment and storage structure.

16. The apparatus of claim 15, wherein:

the alignment and storage structure includes four portions, two portions having peripheral dart recesses separated by a portion having a diameter less than the diameters of the two portions having the peripheral dart recesses, and a fourth portion positioned adjoining one of the two portions having the peripheral dart recesses, the fourth portion having a diameter larger than the diameters of the two portions having the peripheral dart recesses.

17. The apparatus of claim 16, wherein:

each peripheral dart recess has a recess depth to dart diameter ratio of about 1 to 2.

18. A toy dart magazine apparatus comprising:

a housing including;

a first housing portion, and a second housing portion connected to the first housing portion;

an alignment and storage structure having peripheral dart recesses, the alignment and storage structure being rotationally mounted to the housing;

a main spring mounted to the housing for biasing the alignment and storage structure;

an engagement structure for engaging the alignment and storage structure and for engaging a dart;

a flexible arm having first and second end portions, the first end portion being pivotally connected to the main spring and the second end portion being pivotally connected to the engagement structure;

a knob structure connected to the housing, the knob structure defining a plurality of protrusions for engagement with the alignment and storage structure to enable rotational adjustment of the alignment and storage structure where the alignment and storage structure includes a plurality of protrusions;

a knob spring for biasing the knob in an axial direction; and a shaft mounted to the housing with the knob structure being mounted to the shaft, the knob spring mounted to the shaft, and the alignment and storage structure mounted to the shaft.

19. The apparatus of claim 18, wherein:

the alignment and storage structure includes four portions, two portions having peripheral dart recesses separated by a portion having a diameter less than the diameters of the two portions having the peripheral dart recesses, and a fourth portion positioned adjoining one of the two portions having the peripheral dart recesses, the fourth portion having a diameter larger than the diameters of the two portions having the peripheral dart recesses where the knob engages the plurality of protrusions included with the knob with the plurality of protrusions included with the alignment and storage structure.

20. The apparatus of claim 19, wherein each peripheral dart recess is according to a recess depth to dart diameter ratio of 1 to 2.

* * * * *